US011047087B2

(12) United States Patent
D'Oliviera Dias et al.

(10) Patent No.: US 11,047,087 B2
(45) Date of Patent: Jun. 29, 2021

(54) APPARATUS FOR TREATMENT OF LAUNDRY INCLUDING A BASE EQUIPPED WITH A REMOVABLE RESERVOIR

(71) Applicant: SEB S.A., Ecully (FR)

(72) Inventors: Laurent D'Oliviera Dias, Saint Chamond (FR); Florent Peysselon, Lyons (FR)

(73) Assignee: SEB S.A.

( * ) Notice: Subject to any disclaimer, the term of this patent is extended or adjusted under 35 U.S.C. 154(b) by 143 days.

(21) Appl. No.: 16/437,842

(22) Filed: Jun. 11, 2019

(65) Prior Publication Data

US 2019/0376227 A1 Dec. 12, 2019

(30) Foreign Application Priority Data

Jun. 12, 2018 (FR) ..... 1855140

(51) Int. Cl.
*D06F 75/06* (2006.01)

(52) U.S. Cl.
CPC ..... *D06F 75/06* (2013.01)

(58) Field of Classification Search
CPC .... D06F 75/06; D06F 75/14; D06F 81/00–12; D06F 79/00; D06F 79/02; D06F 79/023
See application file for complete search history.

(56) References Cited

U.S. PATENT DOCUMENTS 2,777,226 A * 1/1957 Finlayson ..... D06F 75/12 38/77.6
4,206,340 A * 6/1980 Osrow ..... D06F 75/16 219/245
4,565,019 A * 1/1986 Cavalli ..... B65H 75/4431 38/77.6
5,609,047 A * 3/1997 Hellman, Jr. ..... D06F 73/00 239/538
6,021,591 A * 2/2000 Basile ..... D06F 75/12 38/77.6
6,886,373 B2 * 5/2005 Carrubba ..... D06F 73/00 68/222
9,708,753 B2 * 7/2017 Yoo ..... D06F 81/00
2006/0191299 A1 * 8/2006 Tobias ..... D06F 73/00 68/5 R
2014/0238086 A1 8/2014 Choi et al.

FOREIGN PATENT DOCUMENTS

| | | |
|---|---|---|
| CN | 2547754 Y | 4/2003 |
| DE | 10 2013 105691 A1 | 12/2013 |
| EP | 3 327 196 A1 | 5/2018 |
| FR | 3 068 372 A1 | 1/2019 |

OTHER PUBLICATIONS

Search Report as issued in French Patent Application No. 1855140, dated Feb. 20, 2019.

* cited by examiner

*Primary Examiner* — Ismael Izaguirre
(74) *Attorney, Agent, or Firm* — Lerner, David, Littenberg, Krumholz & Mentlik, LLP

(57) ABSTRACT

Apparatus for steam-treatment of laundry including a base connected by a conduit to an ironing and/or smoothing tool, the base including a removable reservoir and including a side wall which delimits at least one side of a housing for accommodating the reservoir, wherein the side wall includes a window allowing visual access to the contents of the reservoir.

12 Claims, 2 Drawing Sheets

APPARATUS FOR TREATMENT OF LAUNDRY INCLUDING A BASE EQUIPPED WITH A REMOVABLE RESERVOIR

CROSS REFERENCE TO RELATED APPLICATIONS

This application claims priority to French Patent Application No. 1855140, filed Jun. 12, 2018, the entire content of which is incorporated herein by reference in its entirety.

FIELD

This invention relates to an apparatus for steam treatment of laundry including a base connected by a conduit to an ironing and/or smoothing tool, and relates more particularly to an apparatus in which the base comprises a removable reservoir and includes a side wall which delimits at least one side of a housing for accommodating the reservoir.

BACKGROUND

From the Chinese utility model CN2547754U, we know of an ironing apparatus comprising a base, comprising a removable reservoir, connected by a steam conduit to an iron. This apparatus includes a housing for accommodating the reservoir which is provided on the rear of the base and the base includes a side wall which delimits the front part of the housing for accommodating the reservoir.

Such an apparatus has a reservoir which is weakly integrated with the base such that a large portion of the perimeter of the reservoir is still visible. However, the side wall of the base which delimits the front part of the housing for accommodating the reservoir has the drawback of concealing the reservoir when the user is positioned in front of the apparatus, such that the user cannot see the water level in the reservoir when he is in this position.

SUMMARY

Thus, an aspect of this invention is to propose an ironing/smoothing apparatus that corrects this drawback.

For this purpose, an aspect of the invention is an apparatus for steam treatment of laundry including a base connected by a conduit to an ironing and/or smoothing tool, the base comprising a removable reservoir and including a side wall which delimits at least one side of a housing for accommodating the reservoir, characterized in that the side wall includes a window allowing visual access to the contents of the reservoir.

Window is understood to mean any opening allowing visual access to the interior of the housing.

Such a characteristic improves the visibility of the water level in the reservoir by allowing the user to have visual access through the window when he is in a position where the reservoir is normally concealed by the side wall.

According to a beneficial characteristic of the invention, the side wall extends over at least two sides of the housing for accommodating the reservoir.

Such a characteristic makes it possible to visually integrate the reservoir in the base and to protect the latter on at least two of its sides, thus limiting the risk of impact with the reservoir, which could cause the latter to be damaged or disconnected from the base.

According to another beneficial characteristic of the invention, the side wall extends over at least three sides of the housing for accommodating the reservoir.

Such a characteristic further enhances the visual integration of the reservoir in this base and its protection.

According to another beneficial characteristic of the invention, the side wall extends over the entire perimeter of the housing.

Such a characteristic makes it possible to have a reservoir fully integrated in the base.

According to another beneficial characteristic of the invention, the reservoir can be inserted into or extracted from the housing through an access opening provided on one side of the base.

Such a characteristic makes it possible to obtain a base in which the reservoir does not occupy the upper portion of the base.

According to another beneficial characteristic of the invention, the access opening is provided in the side wall.

According to another beneficial characteristic of the invention, the window is provided opposite the access opening.

Such a characteristic makes it possible to offer visual access to the reservoir on the side of the base opposite the access opening.

According to another beneficial characteristic of the invention, the window is an opening through the side wall.

Such a characteristic has the benefit of being simple and economical to implement.

According to another beneficial characteristic of the invention, the window is equipped with a transparent pane.

According to another beneficial characteristic of the invention, the reservoir comprises a transparent or translucent portion positioned opposite the window when the reservoir is arranged in the housing.

According to another beneficial characteristic of the invention, the reservoir comprises a handle.

Such a characteristic simplifies the handling of the reservoir.

According to another beneficial characteristic of the invention, the reservoir includes a transparent or translucent front face and the handle is made in an opaque material which is connected to the front face of the reservoir.

According to another beneficial characteristic of the invention, the apparatus includes a device for locking the reservoir into the housing.

Such a characteristic makes it possible to secure the reservoir to the base, in particular during transport of the base.

According to another beneficial characteristic of the invention, the locking device comprises a latch moved by an elastic return system into a locking position, and an unlocking button allowing the latch to be manually moved into an unlocking position.

According to another beneficial characteristic of the invention, the base includes a transport handle so that it can be moved, the transport handle being beneficially provided on the upper side of the base.

Such a characteristic has the benefit of ensuring very good ergonomics of use.

According to another beneficial characteristic of the invention, the apparatus includes an ironing board mounted such that it can pivot on a pole by means of a hinge device allowing the ironing board to be immobilized in various tilted positions.

According to another beneficial characteristic of the invention, the base comprises an electric pump allowing water to be sent from the reservoir toward the smoothing tool, the smoothing tool comprising an instant steaming chamber.

Such a characteristic makes it possible to have a base that is compact and very simple to make, the steam being produced directly in the steaming chamber supported by the smoothing tool.

According to another beneficial characteristic of the invention, the tool is an iron.

BRIEF DESCRIPTION OF THE DRAWINGS

The purposes, aspects, and benefits of this invention will be more fully understood in consideration of the following description of a particular embodiment of the invention presented as a non-restrictive example, by referring to the attached drawings in which.

DETAILED DESCRIPTION

Only the elements necessary for understanding the invention have been represented. To facilitate reading of the drawings, the same elements bear the same references from one figure to the next. Note that in this document, the terms "horizontal," "vertical," "lower," "upper," "front" and "back" used to describe the apparatus refer to this apparatus when it is resting flat on its stand as illustrated in FIG. 1.

Figure 1:
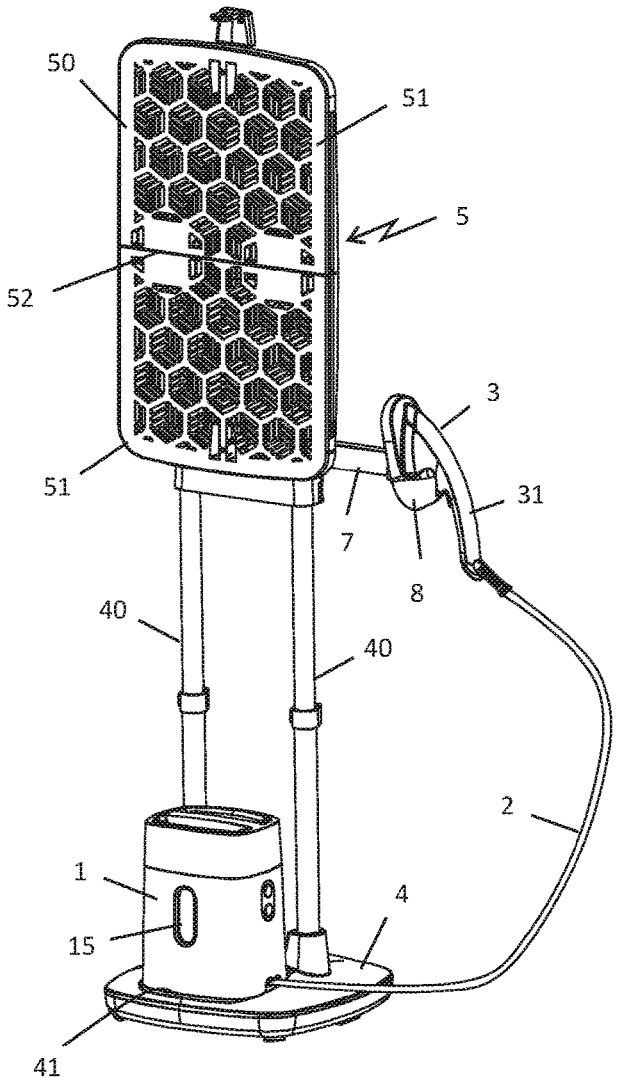
FIGS. 1 and 2 are perspective views of an ironing apparatus according to a particular embodiment of the invention.
Figure 2:
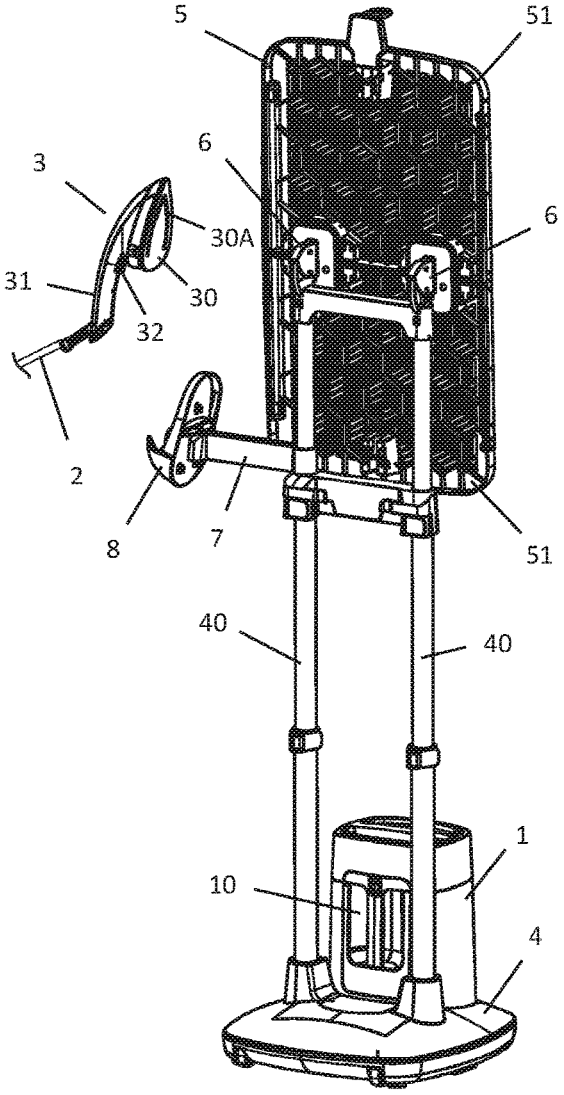

FIGS. 1 and 2 represent a steam ironing apparatus including a portable base 1 connected by a flexible conduit 2 to a steam iron 3, the base 1 being electrically connected to a household network by a cable, not visible in the figures.

The base 1 comprises a removable reservoir 10 and a pump which draws water from the reservoir 10 to send it to the iron 3 through a pipe integrated in the conduit.

The iron 3 comprises, in a manner known per se, a flat soleplate 30 surmounted by a body which comprises a gripping handle 31 comprising a free rear extremity projecting laterally relative to the body. The body contains, in a manner known per se, a casting which is in thermal contact with the soleplate and comprises a heating resistor, controlled by means of a non-adjustable thermostat, allowing the temperature of the soleplate 30 to be maintained around a setpoint temperature of approximately 135° C. (e.g. +/−5° C.).

The casting is beneficial made of aluminum and it includes an instant steaming chamber into which the water coming from the reservoir 10 is injected by the pump, the operation of the pump being controlled by a trigger 32 provided under the front extremity of the gripping handle 31. The pump and the steaming chamber are beneficially sized to allow the production of a continuous steam flow of approximately 25 g/min (e.g. +/−1 g/min) when the trigger 32 is actuated, the soleplate 30 traditionally comprising holes 30A for the emission of steam.

The apparatus also includes a stand 4 on which the base 1 rests removably, the latter being equipped with a transport handle 11 at its upper extremity to facilitate moving it. The stand 4 beneficially includes a recess 41 following the external contour of the base 1 and in which the lower extremity of the base 1 engages.

In an embodiment, the stand 4 comprises two telescopic poles 40 comprising an upper extremity supporting a rigid ironing board 5 comprising a smoothing surface 50, for example flat, intended to be covered with a slipcover, not represented in the figures, and on which laundry to be smoothed can be placed.

The ironing board 5 is mounted such that it can pivot on the extremity of the poles 40 by means of a hinge device 6 to immobilize the ironing board 5 in different tilted positions and beneficially in a vertical position (illustrated in FIGS. 1 and 2), in a horizontal position, and in an intermediate position in which the ironing board 5 beneficially forms an angle of approximately 40° (e.g. +/−5°) with respect to the vertical.

This hinge device 6 is, for example, conforming to the one described in greater detail in the patent application filed in France by the applicant under the filing number FR 1756063.

Beneficially, one of the telescopic poles 40 supports a cross arm 7 at the extremity of which a support device 8 is provided on which the iron 3 can be placed during inactive ironing/smoothing phases.

Figure 3:
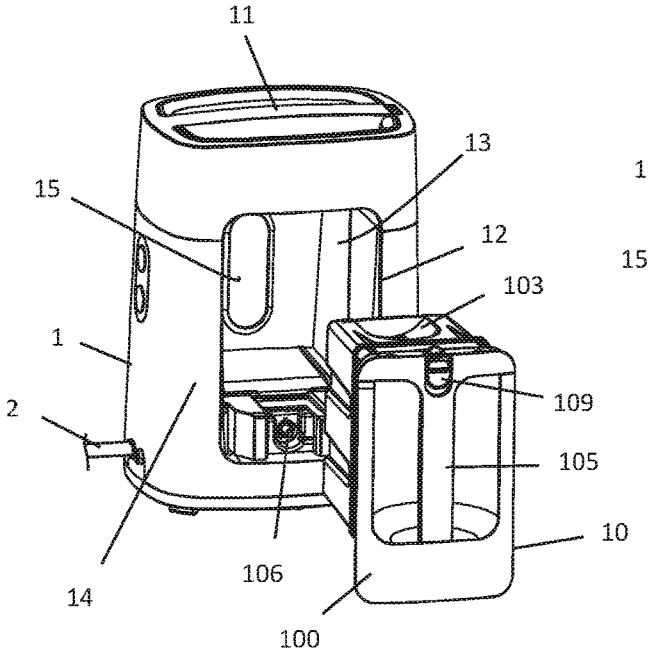
FIGS. 3 and 4 are perspective views of the base represented alone, with the reservoir taken out of the housing.
Figure 4:
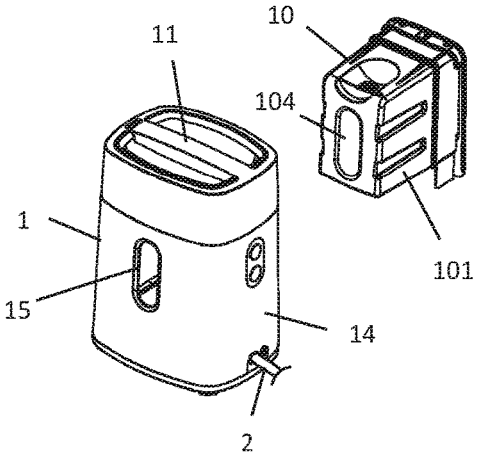

In accordance with FIGS. 3 and 4, the base 1 includes a side wall 14 equipped with an access opening 12 through which the reservoir 10 can be placed into the base 1.

The access opening 12 beneficially has a rectangular general shape and leads to a housing 13 for accommodating the reservoir 10, which is delimited by the side wall 14 of the base 1, the latter comprising, opposite the access opening 12, a window 15 beneficially formed by an opening leading to the housing 13.

Figure 5:
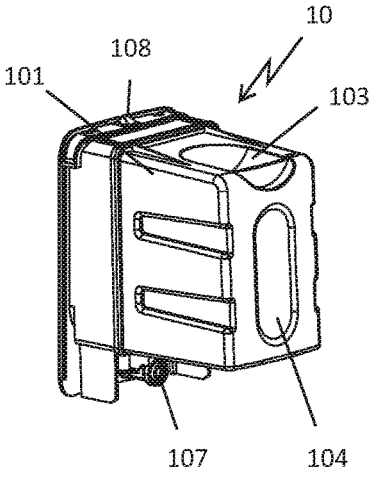
FIG. 5 is a perspective view of the reservoir equipping the base.
Figure 6:
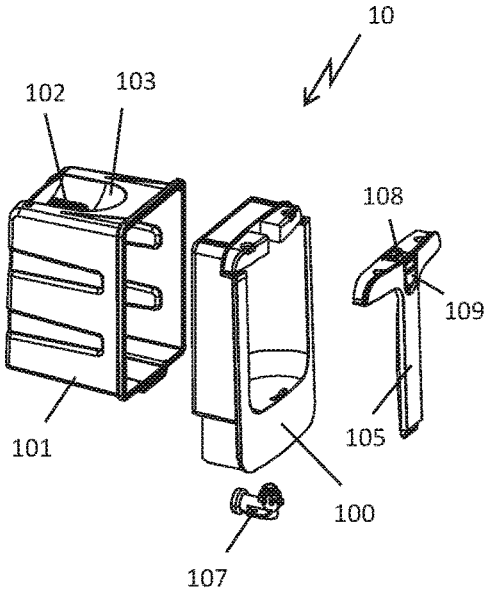
FIG. 6 is an exploded perspective view of the reservoir in FIG. 5.

In accordance with FIGS. 5 and 6, the reservoir 10 includes a front wall 100 which defines the front face of the reservoir 10 and which is tightly connected to a substantially parallelepipedal body 101 engaging in the housing 13 when the reservoir 10 is in an operating position, illustrated in FIGS. 1 and 2. The front wall 100 has a shape complementing that of the access opening 12 and is in line with the side wall 14 of the base 1 when the reservoir 10 is in the operating position.

The body 101 and the front wall 100 define an enclosure which can be filled with water through an orifice 102 provided at the summit of the body 101, this orifice 102 being arranged, in an embodiment, at the bottom of a cavity 103 provided on the upper wall of the body 101, the cavity 103 serving as a funnel.

The body 101 and the front wall 100 of the reservoir 10 are made in a transparent or translucent material which allows the user to see the water level in the reservoir 10 by looking at the reservoir 10 through its front face or its rear face.

In an embodiment, the rear face of the body 101 has a part 104 opposite the window 15 at the level of which the transparency of the body 101 is reinforced, for example by reducing the thickness of the wall or by making this part in a more transparent material.

The front face of the reservoir 10 includes a handle 105 which is beneficially connected to the front wall 100 of the reservoir and can be made in a non-transparent plastic material, such as a colored material.

The handle 105 makes it possible to grasp the reservoir when inserting the reservoir 10 into or removing it from the housing 13, this operation being performed through a translational movement of the reservoir 10 in line with the access opening 12.

In order to ensure fluidic connection of the reservoir 10 with the base 1, the latter is equipped with a connecting end fitting 106 which is arranged in the lower part of the base 1, opposite the access opening 12, this connecting end fitting 106 being fluidically connected to the pump arranged in the base 1.

In accordance with FIG. 5, the reservoir 10 includes a ball valve 107 which connects to the connecting end fitting 106 when the reservoir 10 is in the operating position, the valve 106 being situated under the enclosure of the reservoir 10 and preventing liquid from flowing out of the reservoir 10 when the reservoir 10 is disengaged from its housing 13.

In an embodiment, the reservoir 10 is secured in the operating position by means of a locking device which comprises a latch 108 brought into a locking position by a spring, not visible in the figures, and which can be moved into an unlocking position by means of an unlocking button 109 arranged at the summit of the handle 105.

The apparatus thus realized has the benefit of having great ergonomics of use while being very economical to manufacture.

In particular, the fact that the reservoir 10 can be removed from the base 1 simplifies the operation of filling the reservoir 10 and limits the risk that water may spill onto the base 1.

In addition, the user can check the water level in the reservoir 10 without having to extract it from the base 1, since he can access the water level in the reservoir 10 by looking at the base 1 through its front face, thanks to the transparency of the front face 100 of the reservoir, and also by looking at the base 1 through its rear face, thanks to the presence of the window 15 on the rear face of the base 1 and thanks to the transparency of the part 104 of the body defining the rear face of the reservoir 10.

It will be appreciated that the invention is in no way limited to the embodiment described and illustrated, which has been provided only as an example.

Modifications are still possible, in particular from the point of view of the composition of the various components or by substitution of equivalent techniques, without departing from the scope of protection of the invention.

Thus, in an embodiment variant not represented, the window for visualizing the water level in the reservoir can be closed by a transparent wall instead of being formed by a through opening.

Thus, in an embodiment variant not represented, the base may include a window on each of the three lateral faces of the base not comprising the access opening.

The invention claimed is:

1. An apparatus for steam-treatment of laundry including a base connected by a conduit to an ironing and/or smoothing tool, the base comprising a removable reservoir and including a side wall which delimits at least one side of a housing for accommodating the reservoir, the reservoir being able to be inserted into or extracted from the housing through an access opening provided on one side of the base, wherein the side wall includes a window, provided opposite the access opening, allowing visual access to the contents of the reservoir, the reservoir comprising a transparent or translucent portion positioned opposite the window when the reservoir is arranged in the housing.

2. The apparatus according to claim 1, wherein the side wall extends over at least two sides of the housing for accommodating the reservoir.

3. The apparatus according to claim 2, wherein the side wall extends over at least three sides of the housing for accommodating the reservoir.

4. The apparatus according to claim 1, wherein the side wall extends over the entire perimeter of the housing.

5. The apparatus according to claim 1, wherein the access opening is provided in the side wall.

6. The apparatus according to claim 1, wherein the window is an opening through the side wall.

7. An apparatus for steam-treatment of laundry including a base connected by a conduit to an ironing and/or smoothing tool, the base comprising a removable reservoir and including a side wall which delimits at least one side of a housing for accommodating the reservoir, the reservoir being able to be inserted into or extracted from the housing through an access opening provided on one side of the base, wherein the side wall includes a window, provided opposite the access opening, allowing visual access to the contents of the reservoir, the reservoir comprising a transparent or translucent portion positioned opposite the window when the reservoir is arranged in the housing, wherein the window is equipped with a transparent pane.

8. The apparatus according to claim 1, wherein the reservoir includes a handle.

9. The apparatus according to claim 1, further comprising a locking device adapted to lock the reservoir into the housing.

10. An apparatus according for steam-treatment of laundry including a base connected by a conduit to an ironing and/or smoothing tool, the base comprising a removable reservoir and including a side wall which delimits at least one side of a housing for accommodating the reservoir, the reservoir being able to be inserted into or extracted from the housing through an access opening provided on one side of the base, wherein the side wall includes a window, provided opposite the access opening, allowing visual access to the contents of the reservoir, the reservoir comprising a transparent or translucent portion positioned opposite the window when the reservoir is arranged in the housing, a locking device adapted to lock the reservoir into the housing, wherein the locking device comprises a latch moved by an elastic return device into a locking position, and an unlocking button allowing the latch to be manually moved into an unlocking position.

11. The apparatus according to claim 1, wherein the base includes a transport handle so that the base can be moved.

12. The apparatus according to claim 1, wherein the tool is an iron.

* * * * *